United States Patent [19]

Seko et al.

[11] 4,108,742

[45] Aug. 22, 1978

[54] ELECTROLYSIS

[75] Inventors: Maomi Seko, Tokyo; Shinsaku Ogawa; Muneo Yoshida, both of Nobeoka, all of Japan

[73] Assignee: Asahi Kasei Kogyo Kabushiki Kaisha, Osaka, Japan

[21] Appl. No.: 771,978

[22] Filed: Feb. 25, 1977

Related U.S. Application Data

[63] Continuation of Ser. No. 556,484, Mar. 7, 1975, abandoned.

[30] Foreign Application Priority Data

Mar. 9, 1974 [JP] Japan ..... 49-26775

[51] Int. Cl.[2] ..... C25B 1/16; C25B 1/26

[52] U.S. Cl. ..... 204/98; 204/128

[58] Field of Search ..... 204/98, 128

[56] References Cited

U.S. PATENT DOCUMENTS 3,242,059 3/1966 Cottam et al. ..... 204/98

*Primary Examiner*—R. L. Andrews

*Attorney, Agent, or Firm*—Cooper, Dunham, Clark, Griffin & Moran

[57] ABSTRACT

In an electrolytic cell having cation exchange membrane as diaphragm to partition said cell into cathode and anode chambers, electrolysis of an electrolyte aqueous solution is conducted while generating gas from anode by keeping the inner pressure in cathode chamber higher than that in anode chamber. Some disadvantages caused in the case of electrolyzing an aqueous alkali metal halide solution to form alkali metal hydroxide in cathode chamber are overcome by adjusting the anolyte at pH $<3.5$. The electrolytic cell preferably employable for the present process is also disclosed.

8 Claims, 6 Drawing Figures

Figure 3:
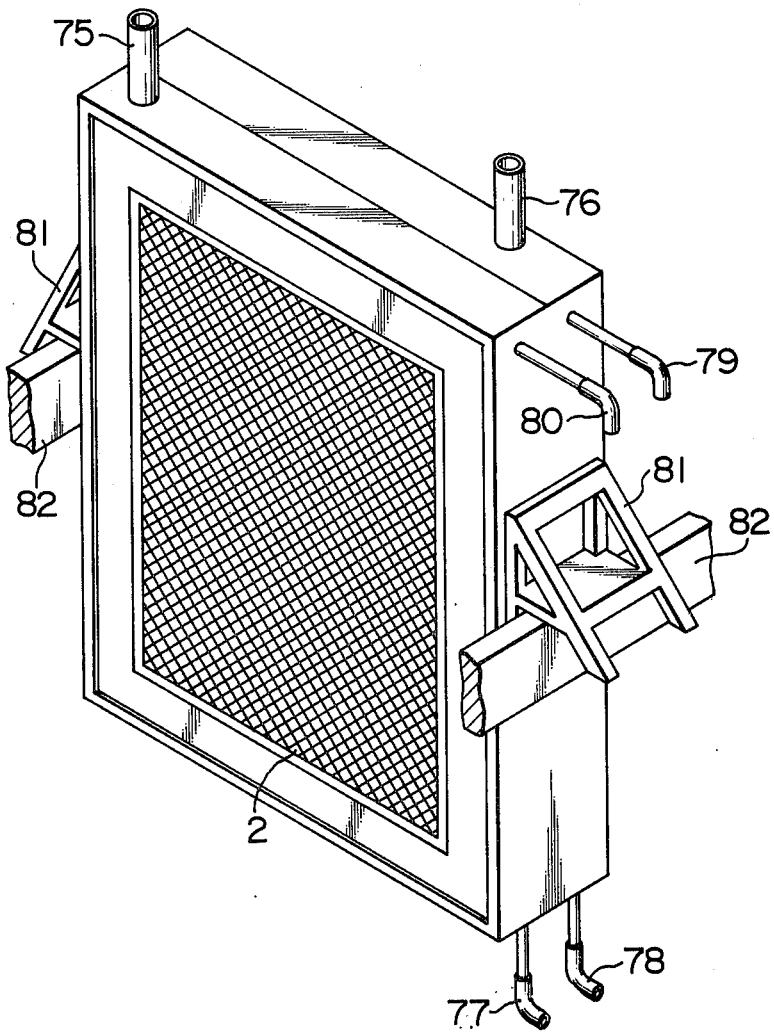

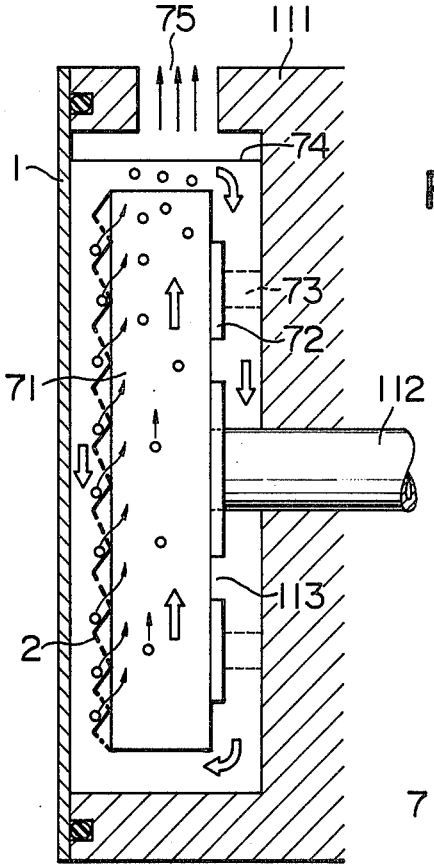
FIG. 1
FIG. 2
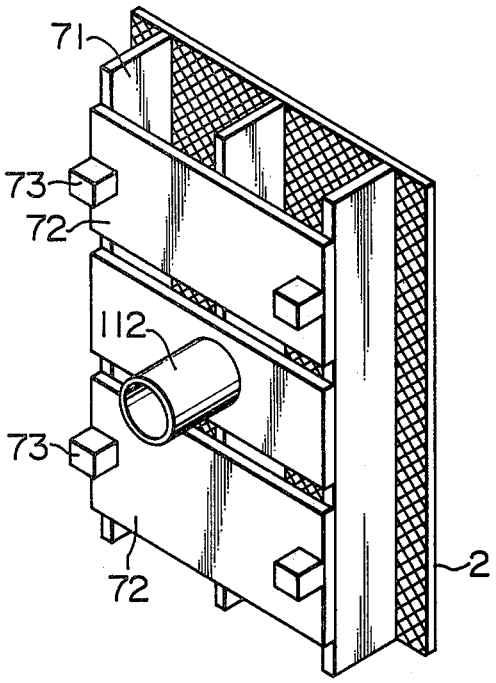

ELECTROLYSIS

This is a continuation of application Ser. No. 556,484 filed Mar. 7, 1975, now abandoned.

This invention relates to an improved electrolysis process and apparatus therefor. More particularly, it relates to an electrolysis process using ion exchange membrane as diaphragm and an electrolytic cell preferably employable for the present process.

The present process and electrolytic cell are widely applicable to, for example, production of sodium hydroxide, chlorine and hydrogen from saline water, production of lithium hydroxide, potassium hydroxide, iodine, bromine, chloric acid, bromic acid, persulfuric acid, etc., and production of adiponitrile from acrylonitrile.

Generally speaking, when a cation exchange membrane is used as diaphragm, desalted products are formed as interfacial layers on the anode side of the cation exchange membrane. This is because the transport number of cations through a cation exchange membrane is usually 80% or more, while that of cations through anode solution is not more than 50% unless the anode solution is strongly acidic. On account of this difference in transport number, when current is passed, desalted interfacial layer is formed in direct proportion to the difference between the transport numbers of cations through cation exchange membrane and anolyte. The salt concentration in the desalted interfacial layer is in inverse proportion to the current density and in direct proportion to the salt concentration in anolyte. It is also in inverse proportion to the thickness of the interfacial layer. Accordingly, there generally exists a current density whereby desalination concentration in the interface is rendered zero, namely limiting current density.

However, even if electrolysis is performed under a current density which is not more than the limiting current density, electric conductivity is impaired by the presence of thick interfacial layer at the time of desalination, whereby higher electrolysis voltage is required. Moreover, as is well known, if electrolysis is performed under a current density which is more than the limiting current density, electrolysis occurs in the interfacial layer to effect sudden increase in electrolysis voltage. Accordingly, in order to perform electrolysis as economically as possible, it is necessarily required to make the thickness of the interfacial layer as thinner as possible, thereby to perform electrolysis under low electrolysis voltage and high current density.

Heretofore, for this purpose, there have been proposed to increase the flow velocity of anode stream or to provide spacer between anode and cation exchange membrane so as to make the interval therebetween uniform and to improve turbulence effect. (For example, refer to Japanese Pat. Publication Nos. 19777/72 and 16189/74, U.S. Pat. No. 3,017,338 and Dutch Patent Application No. 670742.) Furthermore, when spacer is provided, there is no contact between anode and cation exchange membrane or between cathode and cation exchange membrane, and cation exchange membrane can be prevented from burning which may occasionally be caused by locally great current passage due to such contact. However, when spacer is provided, it is practically very difficult to keep the interval between anode and cation exchange membrane to not more than 1 mm. In case when electrolysis is conducted while accompanying generation of gas from anode, the spacer holds the gas generated to effect residence of the gas. Such gas shields passage of current to increase inevitably the electrolysis voltage.

It has now been found that very stable electrolysis can be performed without using spacer when cation exchange membrane is kept in such state that it is pressed towards anode by keeping inner pressure in cathode chamber higher than that in anode chamber.

Thus, the electrolysis process of the present invention is characterized by keeping inner pressure in cathode chamber of the electrolytic cell higher than that in anode chamber. The control of the inner pressure of the chambers is realized by several ways, for example, adjusting difference of gas pressure at the exit of anode chamber and that of cathode chamber, or adjusting an amount of electrolyte solution supplied to each chamber. Other ways suitable for controlling the inner pressure may be employable.

According to the process of the present invention, the cation exchange membrane is never brought into contact with anode because they are separated by the bubble of gas generated from anode. Furthermore, there is no such phenomenon as locally great current passage through cation exchange membrane which causes burning of the membrane. Since the interval between anode and cation exchange membrane can be very narrow and the interfacial desalted layer on cation exchange membrane is always compulsorily stirred by the gas generated from anode, the thickness of the interfacial layer is reduced extremely small to increase remarkably the limiting current density. Due to these effects, electrolysis voltage can be extremely lowered.

When inner pressure in cathode chamber is equal to that in anode chamber, electrolysis voltage is not stable, because the position of cation exchange membrane is not definitely fixed; it is sometimes brought into contact with anode or cathode. As shown in Examples and Reference excamples set forth below, there is possibility of fluctuation of electrolysis voltage within about 0.4 V by contact of the cation exchange membrane with anode or cathode. Furthermore, during electrolysis, the electrolysis cell is always accompanied by fluctuation of pressure due to the generation of gas. Accordingly, in order to expect the effect as mentioned above with certainty, it is critically required that the cation exchange membrane should certainly be pressed against anode by the inner pressure in cathode chamber which is higher than that in anode chamber.

Furthermore, in order to avoid local inversion of pressure even in the presence of small fluctuation of pressure by generation of gas in electrolytic cell, it is preferred to keep the inner pressure in cathode chamber higher by more than about 0.2 m column of water than the inner pressure in anode chamber. If the pressure difference is too large, electrolysis cell, electrode or cation exchange may be broken. Therefore, the pressure difference is usually from 0.2 meter to 5 meter column of water.

As stated above, because there is required no spacer between anode and cation exchange membrane by keeping the inner pressure in cathode chamber higher than that in anode chamber, the interval between anode and cation exchange membrane can be rendered extremely narrow. When electrolysis is carried out while permitting generation of gas from anode, the process suffers from no inconvenience brought about by close contact of anode with cation exchange membrane. Other effects such as narrowed interval between anode and cation exchange membrane or thinned interfacial desalted layer by gas turbulence are also brought about.

When this invention is applied to a process of producing sodium hydroxide in a cathode chamber by electrolysis of saline water, the hydroxy ion ($OH^-$) which has come through an ion exchange membrane immediately contacts with an anode. This contact brings about several disadvantages. Typical one of which is to produce a perchlorate and the other is to increase the amount of oxygen present in chlorine gas.

It has now been found that these disadvantages may be avoided by maintaining the pH value of the anolyte at 3.5 or less. This will be clearly shown by the results of the following experiment set forth in Tables 1 and 2.

Experiment

Electrolysis was conducted under the condition of an electrolytic current density of 50 Amp./dm$^2$ and at temperature of 90° C by using an electrolytic cell having two chambers comparted by cation exchange membrane with an effective electrolytic membrane area of 5 cm × 5 cm, and using as anode the metal plate coated with solid solution of ruthenium oxide and as cathode the iron plate, wherein in the anode chamber 4.2 N saline water was circulated and in the cathode chamber an aqueous caustic soda solution adjusted at 17% was circulated, while the internal pressure of cathode chamber being maintained at 30 cm-Hg higher than that of the anode chamber.

Table 1 shows the rate of formation of chloric acid estimated from the amount of chloric acid ion thus produced.

Table 2 shows the relation between pH value of the saline water and the percentage of oxygen gas in chlorine gas.

Table 1

| Hydrogen ion concentration of saline water | Rate of formation of $ClO_3$ (g/lit. hr) |
|---|---|
| $[H^+] = 0.5$ N | — |
| pH = 1.0 | 0.00 |
| pH = 2.0 | 0.00 |
| pH = 3.0 | <0.05 |
| pH = 3.5 | 0.05 |
| pH = 4.0 | 0.09 |
| pH = 4.5 | 0.39 |
| pH = 5.0 | 0.65 |

Table 2

| Hydrogen ion concentration of saline water | (A) amount of generation of $Cl_2$ gas (lit./hr.) | (B) amount of generation of $O_2$ gas (lit./hr.) | (B)/(A) (%) |
|---|---|---|---|
| $[H^+] = 0.9$ N | 5.12 | $16.9 \times 10^{-3}$ | 0.33 |
| $[H^+] = 0.1$ N | 5.08 | $20.8 \times 10^{-3}$ | 0.41 |
| pH = 1 | 5.07 | $23.3 \times 10^{-3}$ | 0.46 |
| pH = 2.5 | 5.12 | $30.2 \times 10^{-3}$ | 0.59 |
| pH = 3.5 | 5.20 | $31.2 \times 10^{-3}$ | 0.60 |
| pH = 4 | 5.08 | $55.3 \times 10^{-3}$ | 1.09 |
| pH = 4.5 | 5.02 | $74.3 \times 10^{-3}$ | 1.48 |
| pH = 5 | 5.00 | $192.2 \times 10^{-3}$ | 3.84 |

In order to keep the pH of anolyte at or below 3.5, it is recommended to add to the anolyte, one or mixture of mineral acids, e.g. HCl, $H_2SO_4$, $HNO_3$, etc. Among these mineral acids, HCl is particularly preferable. Suitable range of the concentration of the acid is 0.5 N or less. The range larger than 0.5 N, which lowers electric efficiency, is not preferable.

The mineral acid may be added directly to cathode chamber. Or alternatively, the mineral acid is admixed beforehand with saline water, and then supplied to cathode chamber.

The effects of the process of the present invention as mentioned above can be expected even when flat plate electrodes are employed. However, they are particularly conspicuous when electrolysis is performed by using gas-permeable metallic electrodes while discharging the gas generated from electrodes backward of the electrodes.

"Gas-permeable metallic electrode" refers to electrode made of metallic material and having many interstices or openings. Examples of gas-permeable metallic electrodes are expanded sheet, multi-rod sheet, percorated sheet, mesh, etc. As anode, the product obtained by coating an electrode selected from these metallic electrodes with noble metal oxide is particularly preferred.

In the following, the structure of electrolysis cell suitable for practicing the process of the present invention is described in detail.

When gas is generated by electrolysis reaction, gas-permeable metallic electrodes are preferably used. Furthermore, the structure of the electrolysis cell is preferably such that the distance between electrode and inside of partition wall in each chamber is made larger than that between cation exchange membrane and the electrode, thereby permitting the gas generated on electrode surface at the current passing portion to ascend in the space behind the electrode and circulating electrolyte with little gas content between the membrane and the electrode. More particularly, when the gas generated on electrode surface at the current passing portion is permitted to ascend in the space behind the electrode by using a gas-permeable metallic electrode and an electrolysis cell wherein the non-current passing space behind the electrode in each chamber is made larger than that between cation exchange membrane and the electrode, a downcomer is preferably provided between partition wall and the gas-ascending space. If the electrolysis cell has such a structure, the gas generated by electrolysis can be led quickly from front of the electrode to the gas-ascending space therebehind, thereby permitting an electrolyte with very little gas content to exist in the space between the cation exchange membrane and the electrode and permitting said electrolyte to circulate and stir the membrane surface and the electrode surface to decrease voltage drop. Under these conditions, electrolysis can be carried out at high current density.

Figure 4:
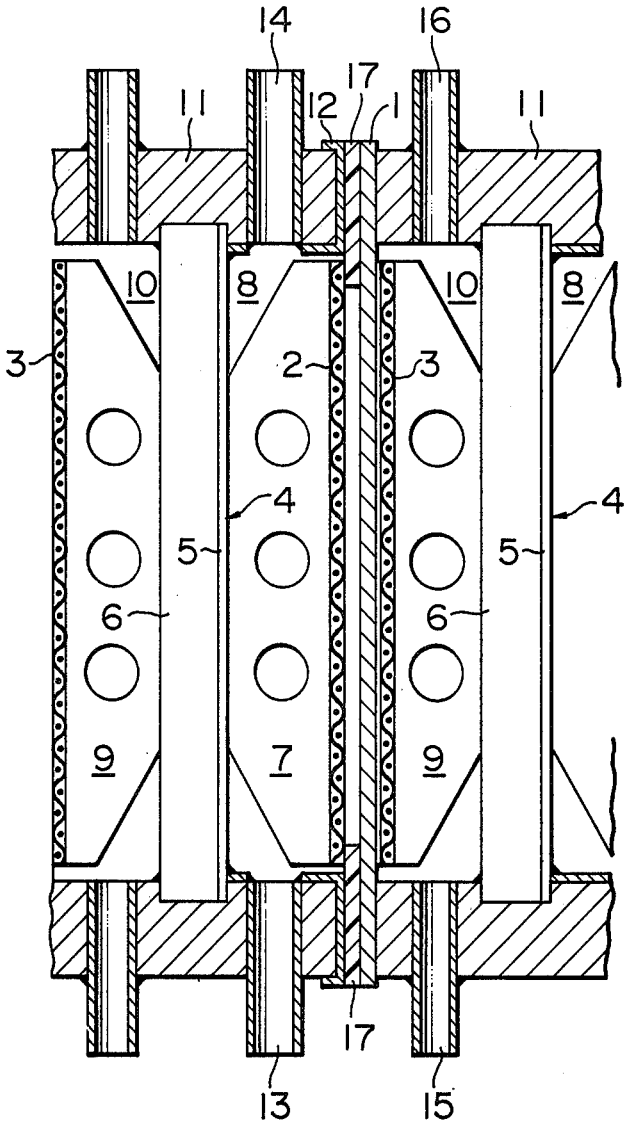
Figure 5:
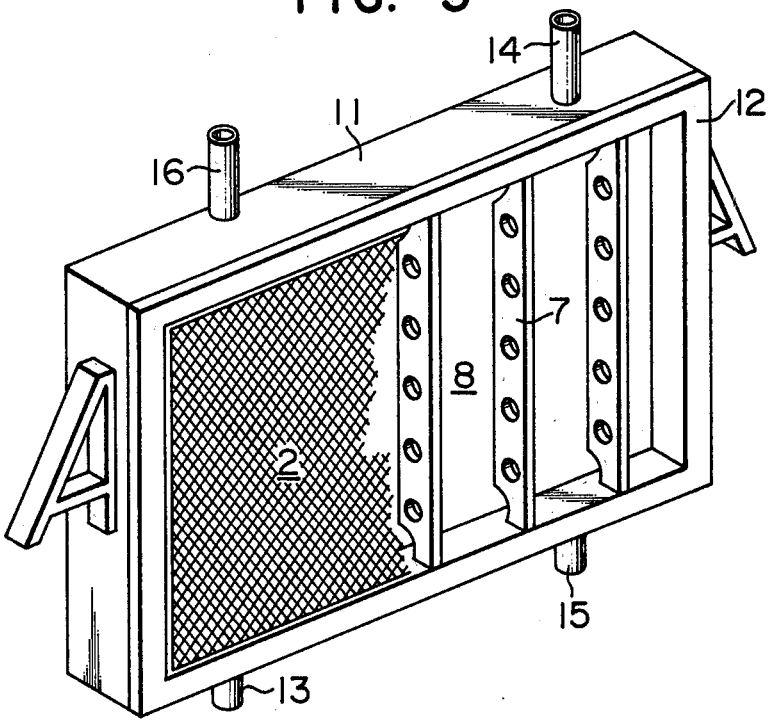
Figure 6:
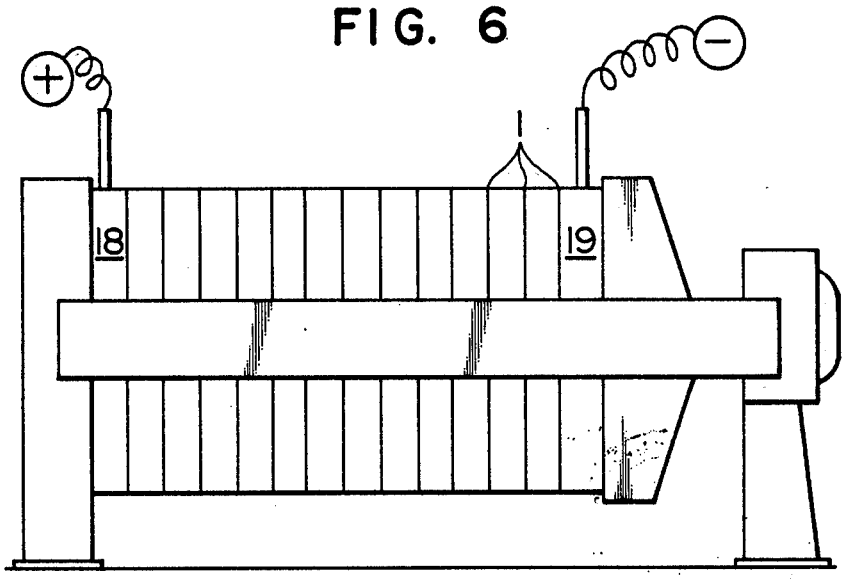

For the purpose of illustration of electrolysis cells which are particularly suitable for practicing the process of the present invention, reference is now made to the annexed drawings, in which:

FIG. 1 shows a schematic drawing for illustration of the principle for electrolysis cell;

FIG. 2 a slant view of electrode (the same as anode);

FIG. 3 a slant view of electrode of unit electrolysis cell;

FIG. 4 a partial cross-sectional view of a bipolar system electrolysis cell;

FIG. 5 a diagonal view of a bipolar system electrolysis cell viewed from the anode side; and FIG. 6 an assembly drawing of a bipolar system electrolysis cell.

Referring now to FIG. 1, 2 shows a metal electrode with expanded sheet structure. Bubbles of chlorine gas are formed by electrolysis on the electrode surface at the current passing side. Since the space formed by the support 71 behind the anode 2 is larger than that between the cation exchange membrane and the anode, the gas is flown to behind the anode 2, accompanied by flow of liquid, and ascends through the space. The facial portion of the anode is preferably slanted and curved from the vertical line towards the support 71, as shown in FIG. 1, because the gas generated on the front side (facing the membrane) of the electrode is spontaneously led to the space behind the electrode mesh and the electrolyte is transported upward by pump action to prevent the space between the electrode and the ion-exchange membrane from ascending of the gas therethrough. Even when the electrode surface is flat and not slanted toward the electrode support 71 as in FIG. 1, similar flow of electrolyte and gas occurs so long as the space behind the electrode is larger than that between the electrode and the membrane. However, in principle, such a tendency is increased as the mesh electrode surface is slanted toward the support. After the bubbles of chlorine gas ascended through the space behind the electrode mesh in this manner, the gas is separated from the liquid at the free surface in the upper part of each chamber to be discharged out of the outlet 75. The liquid descends through the downcomer 113 between the gas-ascending space and the partition wall 111 and, by way of circulation, promotes flowing of the liquid between the mesh electrode and the cation exchange membrane. In FIG. 1 and FIG. 2, 72 is the partition wall between the gas-ascending space and the downcomer 113 which also serves as conductive plate; 73 is the distance piece between the partition wall 111; 112 is the conductive rod.

In case when gas is generated from cathode, the flow of the liquid is promoted and the ratio of gas to liquid is decreased by providing the cathode chamber with the same structure as shown in FIG. 1 and FIG. 2. Shielding of current by gas can thus be avoided.

In industrial applications, bipolar system electrolysis cell is preferably used, because it is easy to elevate the voltage of direct current source and reduce the quantity of direct current. In the bipolar system electrolysis cell, anode chambers and cathode chambers are arranged in series alternately. The anode chambers and the cathode chambers are separated from each other by means of cation exchange membranes and partition walls.

The cathodes and the anodes are placed at both sides of cation exchange membranes as near as permissible from manufacturing precision. Accordingly, space for anode chamber is provided between anode and partition wall. When gas is generated also from cathode, there is also provided a space for cathode chamber between cathode and partition wall.

The anode and the neighboring cathode are connected electrically to each other in bipolar system electrolysis cell via partition wall.

The cation exchange membrane and the partition wall are flat and are preferably vertically parallel to each other, because gases in anode and cathode chambers can easily be separated. For improvement of separation of gases, such means as controlling plates can be provided in anode and cathode chambers.

In the process according to the present invention, the inner pressure in cathode chamber is kept higher than that in anode chamber and therefore there is always no fear of contact of cathode with cation exchange membrane. Accordingly, so long as the structure is such that cathodes and anodes are arranged at fixed intervals, there is also no need to provide spacer between cathode and cation exchange membrane. In case when gas is generated from cathode, it is preferred to omit spacer at cathode side because there is no fear of gas holding by spacer which shields current.

The bipolar system electrolytic cell, which is suitably used for practicing the process of the present invention consists of an assembly wherein multiple electrolysis cell units are combined by interposition of cation exchange membranes 1 therebetween, each electrolysis cell unit comprising anode and cathode which are fixed front and back through the partition wall 111 and electrically connected by means of the conductive rod 112.

In FIG. 3, 2 is gas-permeable metallic anode, cathode being provided backside thereof separated by the partition wall; 75 is the outlet for anode gas; 76 is the outlet for cathode gas; 77 is the inlet for anolyte; 78 is the inlet for catholyte; 81 is the support; and 82 is the side bar. The downcomer portion is designed to be within the distance such that the ascending velocity of the gas may be great. As shown in FIG. 1, the electrolysis cell is equipped with a downcomer. The downcomer is provided for the purpose of increasing the ascending velocity of gas-liquid mixture through the space behind the porous electrode. In the absence of such downcomer, the descending velocity of the liquid through the space between the membrane and the electrode is somewhat lower. As the result, a small amount of gas may sometimes be present in the space between the membrane and the electrode. This, however, makes no substantial difference. Accordingly, it is suitably designed in a manner such that each breadth is determined according to current density and the interval between the electrode and the membrane.

The distance piece 73 is provided to fix both cathode and anode to the partition wall 111, respectively, whereby the positions of the electrodes are fixed. The anode and cathode chambers are connected by means of the conductor 112 which passes through the partition wall 111 and both electrolytes are sealed mutually by means of gasket. The anode and cathode meshes are fixed on the mesh support 71 by suitable method such as welding, etc. The mesh support 71 and the conductive metal 112 must be made of a metal which is corrosion resistant to the electrolyte.

Generally speaking, when the electrodes of bipolar system electrolytic cell are in the form of flat plates, each electrode may be used as a partition wall between the cathode chamber and the anode chamber, but if the electrodes are porous, it is necessary to use a partition wall which is separate from the electrode. As such partition wall, there may be used any material so far as it can sufficiently withstand the electrolyte, the electrolysis product, the electrolysis temperature, etc. Preferable examples of such partition wall are plastic plates, plastic-lined plates, concrete walls, metal plates and plates by explosive bonding of titanium plates onto iron plates.

As cathode materials, gas-permeable iron plates such as iron mesh, nets, porous plates and the like or plated products thereof plated with nickel or nickel alloy are suitable. The ratio of the area of the openings of a mesh to that of the metal portion of said mesh or the diameter of a rod and the breadth of the interstices may suitably selected so as to help gas discharge. Alternatively, in place of a mesh, the cathode may have a structure such that a number of wire-like metal rods are arranged in the horizontal direction so that the gas may be discharged from between the respective rods backward of the cathode. It is important that there should exist much vacant space in the cathode which can permit the gas to be discharged from the front of the metal electrode to the back thereof and the cathode should be excellent in mechanical strength.

As cation exchange membranes, any kind of cation exchange membrane can be used. In general, there may be used cation exchange membranes made of a polymer of perfluorosulfonic acid compound; sulfonic acid type cation exchange membranes prepared by polymerization of styrene-divinyl benzene followed by sulfonation; carboxylic acid type cation exchange membranes prepared by polymerization of acrylic acid-divinyl benzene; phosphoric acid type cation exchange membranes; and the like. Particularly, from the standpoint of resistance to chlorine, the membranes prepared from substrates of fluoro-containing compounds are preferred. The cation exchange membranes to be employed in the process of the present invention are preferably high in cation permselectivity, comparatively thin in the range within which reverse diffusion from cathode chamber to anode chamber is little and low in electric resistance. Furthermore, it is desirable that the cation exchange membranes should not suffer from deformation such as swelling or shrinkage under the electrolysis conditions during electrolysis. For this purpose, the cation exchange membranes are preferably reinforced by Teflon nets or other materials.

The process of the present invention can be applied for any electrolysis process wherein cation exchange membranes are used. For example, it may be applied for a process wherein electrolysis cell between anode and cathode is partitioned by one cation exchange membrane into two compartments, and aqueous saltous solution is filled in anode chamber and aqueous caustic solution in cathode chamber, respectively. Alternatively, a multi-compartment system wherein two or more membranes are employed to partition the cell into three or more compartments can also be used.

The interval between the membrane and the electrode in electrolysis cell is determined by taking the manner of gas discharge or other factors into consideration. In general, the interval is suitably from 0.5 to 5 mm, preferably from 0.5 to 1.5 mm, so far as permitted within mechanical precision.

The electrolysis of the present invention may be performed at a temperature suitably selected in the range from 20° to 200° C. In view of the permissible temperature for materials employed, the temperature is preferably from 50° to 100° C.

The current density may suitably within 10 to 200 $A/dm^2$. It is preferably as high as possible, so far as extreme voltage rise is not effected. Suitable economical current density is higher than in case of diaphragm process, namely from 20 to 80 $A/dm^2$.

When it is intended to perform electrolysis of an aqueous sodium chloride solution, a purified aqueous sodium chloride solution near saturation as anolyte, similarly as in conventional electrolysis of sodium chloride.

The amount of supply of the aqueous sodium chloride solution into each anode chamber is selected so that the efficiency of utilization of sodium chloride may be from 5 to 50%. Into a cathode chamber, water or a dilute aqueous caustic soda solution is supplied to keep the concentration of the outlet caustic soda constant.

The present invention is illustrated in more detail below with reference to examples.

EXAMPLE 1

The method of the present method was effected by use of a bipolar system electrolytic cell, the partial cross-section of which is as shown in FIG. 4 of the accompanying drawings.

In FIG. 4, the cation-exchange membrane 1 is a sulfonic acid type cation-exchange membrane composed mainly of fluorine resin; the anode 2 is an electrode prepared by expanding a titanium plate of 1.5 mm. in thickness to a perforated plate (porosity 60%) and then coating the perforated plate with a solid solution comprising 55 mole % of ruthenium oxide, 40 mole % of titanium oxide and 5 mole % of zirconium oxide; and the cathode 3 is a perforated plate (porosity 60%) prepared by expanding an iron plate of 1.6 mm. in thickness.

Both the anode 2 and the cathode 3 are 1.2 m. in length and 2.4 m. in width, and have been maintained vertically in parallel to each other at an electrode distance of 2 mm. The partition wall 4 used in this case is one obtained by explosion-bonding a titanium plate 5 of 1 mm. in thickness onto an iron plate of 9 mm. in thickness, and has been positioned at the anode side. The space between the anode 3 and titanium side 5 of the partition wall has been electrically connected by welding through a titanium plate rib 7 of 4 mm. in thickness, 25 mm. in width and 1.2 m. in length, whereby an anode chamber 8 is provided in the space portion at the back of the anode of 25 mm. in thickness. The rib 7 has been provided vertically, and 10 holes of 10 mm. in diameter have been bored in the rib in order to make favorable the horizontal mixing of gases or anolyte. The space between the cathode 3 and the iron side 6 of the anode has been electrically connected by welding through an iron plate rib 9 of 6 mm. in thickness, 45 mm. in width and 1.2 m. in length, whereby a cathode chamber 10 is provided in the space portion at the back of the cathode of 45 mm. in thickness. The rib 9 has been provided vertically, and 10 holes of 10 mm. in diameter have been bored in the rib in order to make favorable the horizontal mixing of gases or catholyte. The peripheries of the anode chamber 8 and the cathode chamber have been surrounded by an iron frame 11 of 16 mm. in thickness. At portions in contact with the anolyte, the iron frame has been lined with a titanium plate of 2 mm. in thickness. The iron frame 11 has been equipped with a charging nozzle 13 and a discharging nozzle 14 for the anolyte, and a charging nozzle 15 and a discharging nozzle 16 for the catholyte.

74 Units of such electrolytic cell as mentioned above are arranged in series, and the cation-exchange membrane 1 is interposed between the individual cells. At the same time, an ethylene-propylene rubber packing 17 is applied to the working side of the iron frame 11 in order to maintain at 2 mm. the interval between the anode and the cathode and to prevent the electrolyte from leakage. No spacer are used in the current passage portions between the anode and the cation-exchange membrane and between the cathode and the cation-exchange membrane. On both ends of the units, there are provided, respectively, an electrolytic cell unit 18 having only the anode chamber and an electrolytic cell unit 19. These units are placed on a filter press stand to assemble a bipolar system electrolytic cell.

FIG. 5 shows a slant view of the bipolar system electrolytic cell when viewed from the anode side, and FIG. 6 shows the assembled state of the bipolar system electrolytic cell units.

A direct current voltage is applied to both ends of the bipolar system electrolytic cell, whereby the current flows in series through the individual cell units. A catholyte and an anolyte are individually charged in series from respective headers through flexible hoses into the individual cell units, and then discharged. The catholyte is charged from a catholyte tank through a catholyte header into the cathode chamber of each cell unit by means of a pump. Subsequently, the catholyte, in the form of a gas-liquid mixture, is discharged as it is, recycled in the catholyte tank, and subjected to gas-liquid separation. Likewise, the anolyte is charged from a catholyte tank through an anolyte header into the anode chamber of each cell unit by means of a pump. Subsequently, the anolyte, in the form of a gas-liquid mixture, is discharged as it is, recycled in the anolyte tank, and subjected to gas-liquid separation.

Using such electrolytic cell as mentioned above, electrolysis was conducted, using aqueous sodium chloride as the anolyte and sodium hydroxide as the catholyte. Into each electrolytic cell, both the catholyte and the anolyte were charged at a rate of 600 liters per hour. To the anolyte tank, saturated aqueous sodium chloride and hydrochloric acid were added so that the sodium chloride concentration became 2.5 N and the pH became 3 at the outlet of the anolyte chamber. To the catholyte tank, pure water was added so that the sodium hydroxide concentration became 5 N at the outlet of the cathode chamber. Both the cathode chamber and the anode chamber were maintained at an electrolysis temperature of 90° C. To the electrolytic cell a direct current was flowed at a current density of 50 A/dm$^2$, i.e. a direct current of 14,200 amperes.

As the result, chlorine gas was generated from the anode, and hydrogen gas from the cathode. The difference between the inner pressure of the cathode chamber and that of the anode chamber was controlled by controlling the inner pressures of the anolyte and catholyte tanks, and the pressure difference between the two chambers was measured by means of a mercury manometer. The relation between the pressure difference between the two chambers and the electrolysis voltage per unit cell was as shown in Table 3.

Table 3

| Pressure difference (m. water column) | Electrolysis voltage (volts) |
|---|---|
| −1 | 4.11 |
| 0 | 3.7–3.9 |
| +0.2 | 3.72 |
| +1 | 3.65 |
| +2 | 3.65 |
| +5 | 3.65 |

Note: The mark "+" shows that the inner pressure of the cathode chamber was higher than that of the anode chamber.

From Table 3, the effect of the present invention is clear.

The electrolytic cell used in the above was disassembled, but no such phenomenon as burning or the like damage of the cation-exchange membrane was observed at all.

EXAMPLE 2

In the electrolytic cell of Example 1, the titanium plate rib 7 and the iron plate rib 9 were varied in width thereby varying the thicknesses of the cathode and anode chambers.

Using such electrolytic cell, electrolysis was effected in the same manner as in Example 1, except that the electrolysis temperature was 70° C., the current density was 30 A/dm$^2$, the electrode distance between the cathode and anode was 5 mm., and the inner pressure of the cathode chamber was maintained 2 m. (water column) higher than that of the anode chamber.

In this case, the variations in electrolysis voltage per unit cell were as shown in Table 4.

Table 4

| Thickness of cathode chamber (mm) | Thickness of anode chamber (mm) | Electrolysis voltage (volts) |
|---|---|---|
| 60 | 10 | 3.26 |
| 50 | 20 | 3.25 |
| 40 | 30 | 3.27 |
| 30 | 40 | 3.29 |
| 10 | 60 | 3.33 |
| 5 | 40 | 3.45 |
| 10 | 40 | 3.39 |
| 20 | 40 | 3.34 |
| 30 | 40 | 3.29 |
| 40 | 40 | 3.27 |
| 50 | 40 | 3.26 |
| 60 | 40 | 3.26 |

REFERENCE EXAMPLE 1

The electrolysis of Example 1 was repeated, using the same electrolytic cell as in Example 1, except that spacers having a porosity of 60%, which had been prepared by forming cuts in a Teflon cloth of 1 mm. in thickness and then expanding the thus treated cloth, were inserted individually between the anode and the cation-exchange membrane and between the cathode and the cation-exchange membrane. As the result, no such great depression of electrolysis voltage as seen in the present invention was observed no matter how the difference between the inner pressure of the anode chamber and that of the cathode chamber was varied. Moreover, the electrolysis voltage already reached 3.7 volts at a current density of 12 A/dm$^2$, and no such high current density and low electrolysis voltage as in Example 1 could be attained.

EXAMPLE 3

Using a two-compartment electrolysis apparatus having effective electrolysis membrane area of 5 cm × 5 cm. 2.5 N aqueous sodium chloride solution was recycled through a vessel of about 5 liter capacity into anode chamber and an aqueous caustic soda solution previously prepared to 17% was recycled through a similar vessel of about 5 liter capacity into cathode chamber. Each electrolyte was maintained at 75° C and continuous electrolysis was performed for 120 hours under current density which was equally 50 A/dm$^2$ both at membrane surface and anode plate surface. During electrolysis, the anolyte of an aqueous sodium chloride solution was kept at a concentration within 2.3 to 3.0 N by adding intermittently solid sodium chloride of first grade reagent. At the same time, pH detector was equipped at a certain position in the pipe for circulation of the aqueous sodium chloride solution, whereby addition of hydrochloric acid into the vessel for the aqueous solution was automatically controlled to maintain pH of the aqueous sodium chloride solution at 2.0 ± 0.2. The inner pressure in cathode chamber was kept higher by 1 m. column of water than that in anode chamber.

As electrodes, an anode wherein a solid solution of ruthenium oxide and titanium oxide was coated on metallic titanium was used and a cathode wherein nickel rhodanide was plated on iron surface was used. As cation exchange membrane, a sulfonic acid type ion-exchange membrane with thickness of 1 mm. having polypropylene fabric as core material.

After continuous electrolysis has been performed for 120 hours, there was detected no chloric acid ion in anolyte. The oxygen gas content in the chloride gas between 119th hour and 120th hour was found to be 0.39%.

When the above Example is repeated by using an anode wherein a portion of ruthenium or platinum is precipitated in admixture in the noble metal coating, the same result obtained.

EXAMPLE 4

Using the same apparatus as used in Example 3, 4.2 N aqueous sodium chloride solution was recycled through a vessel of about 5 liter capacity into anode chamber and an aqueous caustic soda solution previously prepared to 17% was recycled through a similar vessel of about 5 liter capacity into cathode. Each electrolyte was kept at 90° C and electrolysis was continued under current density of 50 A/dm$^2$ equally both at the membrane surface and anode plate surface.

During electrolysis, the concentration of sodium chloride in anolyte was kept within the range of 4.2 N $\pm$ 0.2 N by adding intermittently solid sodium chloride thereto. At the same time, a portion of anolyte was sampled from time to time from the circulation system of anolyte to measure the acid concentration thereof. The acid concentration was adjusted to 0.2 N $\pm$ 0.1 N by addition of suitable amount of hydrochloric acid. The inner pressure in cathode chamber was kept higher by 1 m. column of water than that in anode chamber.

As anode, a plate electrode having ruthenium oxide coating applied in thickness of about 3 $\mu$ on titanium alloy with thickness of 1 mm. was used and an iron plate was used as cathode. A carboxylic acid type ion-exchange membrane with thickness of 0.7 mm. having polypropylene cloth as core material was used as cation exchange membrane.

Electrolysis was carried out using the above apparatus under the conditions as mentioned above and the amounts of caustic soda and chloric acid formed during electrolysis were measured. Furthermore, the composition of the chlorine gas formed during 1 hour before completion of the electrolysis was analyzed.

As the result, the amount of caustic soda was 687.1 g. and the proportion thereof to the theoretical electric amount was 92.1%. No formation of chloric acid was observed in the anolyte. Furthermore, the proportion of oxygen gas contained in the chlorine gas formed during 1 hour before completion of the electrolysis was 0.44%.

EXAMPLE 5

An aqueous sodium chloride solution was electrolyzed over a long period of time using an electrolytic cell assembly composed of 3 pairs of two-compartment electrolytic cells, connected in series, having an effective electrolysis area of 100 dm$^2$ (100 cm $\times$ 100 cm).

As the ion-exchange membrane was used a sulfonic acid type cation-exchange resin membrane composed mainly of fluorine resin.

In the electrolysis, the amount of the aqueous sodium chloride solution was so controlled that the concentration of sodium chloride in the solution charged into the electrolytic cell became 290 to 310 g/l and the concentration of sodium chloride in the anolyte discharged from the electrolytic cell became 240 to 260 g/l, by providing such a recycle system that the solution was recycled through electrolytic cell, dilute aqueous sodium chloride solution tank, sodium chloride dissolution tower, ion-exchange resin tower for removal of calcium and magnesium, and saturated sodium chloride solution purification tank, in this order.

Furthermore, the aqueous sodium chloride solution charged into the electrolytic cell had previously been incorporated with hydrochloric acid, so that the anolyte discharged from the electrolytic cell could be maintained at a pH of 2.5.

In the cathode chamber, about 17% of sodium hydroxide was always recycled.

The electrolysis was performed while pressing the cation-exchange membrane to the anode by making the inner pressure of the cathode chamber higher by 0.3 m. column of water than that of the anode chamber.

Using the above-mentioned apparatus, continuous electrolysis was effected for 65 days (about 1,600 hours) under the conditions of an electrolysis temperature of 75° C and a current density of 40 A/dm$^2$.

During the electrolysis, the concentration of chloric acid ion was periodically measured. As the result, during 20 days after initiation of the electrolysis, the concentration of chloric acid ion increased little by little, but after 25th day of the electrolysis, the concentration of chloric acid ion became substantially constant showing a value of 0.2 g/l in terms of the concentration of sodium chlorate, and the operation was conducted stably without any such detrimental effect as decrease in solubility of sodium chloride.

The proportion of oxygen gas in chlorine gas during the operation was in the range from 0.1 to 0.2%, in average.

The current efficiency of formed sodium hydroxide was about 95%.

The anode used was an electrode prepared by coating a titanium mesh having a thickness of 1.5 mm. and a porosity of 60% with a solid solution comprising 70 mole % of ruthenium oxide, 20 mole % of titanium oxide and 10 mole % of zirconium oxide, while the cathode used was an iron mesh having a thickness of 1.5 mm. and a porosity of 60%.

EXAMPLE 6

A copolymer of perfluoro[2-(2-fluorosulfonyl-ethoxy)-propylvinyl ether] with tetrafluoroethylene was molded into a membrane of 0.1 mm. in thickness. This membrane was bonded with a Teflon net and then hydrolyzed to prepare a cation-exchange membrane having a thickness of 0.12 mm. The thus prepared cation-exchange membrane was impregnated at 90° C. with a monomer solution comprising 30 parts of styrene, 20 parts of acrylic acid acid and 30 parts of divinylbenzene, and then polymerized at 100° C. to obtain a cation-exchange membrane. Using the thus obtained membrane which had been cut to pieces of 1.2 m$^2$ in area, there was prepared an assembly of 50 pairs of bipolar system electrolytic cells having mesh electrodes for such electrolytic cells as shown in FIGS. 1, 2 and 3 which were 1 m$^2$ in effective area. In the above, the anode was a mesh electrode prepared by expanding a titanium plate of 1.5 mm. in thickness which had been coated by fusion with ruthenium oxide and processed in such a manner as shown in FIG. 4. The cathode was a mesh electrode prepared by plating an iron mesh of 1.5 mm. in thickness with nickel sulfide. The conductor used to connect the two electrodes was fastened by screwing. In each chamber, the interval between the cation-exchange membrane and the mesh electrode was made 2 mm.

The interval of gas-ascending space represented by 71 in FIG. 1 was 30 mm., and the width of downcomer was 7 mm.

In the anode chamber, 305 g/l of a purified aqueous sodium chloride solution was recycled at a flow rate of 11,515 kl/hr. To the exit solution of the cathode chamber, 10,063 kg/hr of water was continuously added so that the concentration of the resulting sodium hydroxide became 20%. The inner pressure of the cathode chamber was kept higher by 2 mm. column of water than that of the anode chamber.

Using the above-mentioned apparatus, electrolysis was conducted while applying a current of 5,000 amperes to the electrodes at both ends. As the result, the amount of chlorine generated in the anode chamber was 314.5 kg/hr, and the amount of 20% sodium hydroxide solution obtained in the cathode chamber was 15,211.8 kg/hr. Furthermore, the amount of hydrogen obtained in the cathode chamber was 9,325 g/hr. In this case, the current efficiency was 95.1%, and the voltage of each electrode was 3.86 volts. The operation could be stably performed over a long period of time.

EXAMPLE 7

A copolymer of perfluoro[2-(2-fluorosulfonyl-ethoxy)-propylvinyl ether] with tetrafluoroethylene was molded into a membrane of 0.12 mm. in thickness. This membrane was hydrolyzed, impregnated at 80° C. with a solution of perfluoroacrylic acid, and then polymerized to obtain a cation-exchange membrane of 0.14 mm. in thickness and 1.2 m × 1.2 m in area. Using the thus obtained cation-exchange membrane, there was prepared an assembly of 50 pairs of electrolytic cells, in which a gas-liquid separation chamber had been provided at the upper part of each cell as shown in FIGS. 1, 2 and 3. The electrolytic cell thus prepared was identical in shape with that of Example 6, except the gas-liquid separation portion and the mesh anode. The anodes used in this Example were electrodes prepared by arranging horizontally and in parallel ruthenium oxide-coated titanium rods of 3 mm. in diameter so that the interval between the rods became 20 mm. In this case, the effective current passage area of each electrode was 1 $dm^2$.

In the anode chamber, 305 g/l of a purified aqueous sodium chloride solution was recycled at a rate of 12,820 kl/hr. To the exit solution of the cathode chamber, 1,127.4 kg/hr of water was continuously added so that the concentration of sodium hydroxide in the exit solution became 31.1%.

Using the above-mentioned apparatus, electrolysis was conducted while applying a current of 5,000 amperes to the electrodes at both ends. As the result, the amount of chlorine obtained from the anode chamber was 311.2 kg/hr, the amount of sodium hydroxide obtained from the exit of the cathode chamber was 1,127.4 kg/hr, and the amount of hydrogen generated was 9,325 g/hr. In this case, the current efficiency of sodium hydroxide was 96.1% and could be stably maintained for a long period of time, and the voltage of each electrode was 3.95 volts.

What is claimed is:

1. A process for the electrolysis of an aqueous alkali chloride solution in a bipolar electrolytic cell, the cell being partitioned by a cation exchange membrane into cathode and anode chambers, the cathode and anode being formed of gas permeable metallic plates, said process comprising conducting electrolysis while generating chlorine gas at the anode and hydrogen gas at the cathode and discharging said gases in back of the respective electrodes while controlling the pressure in the cathode chamber so that it is higher than the pressure in the anode chamber, thereby to press the cation exchange membrane towards but not against the anode so that the width of the desalted layer between the membrane and the anode is reduced to a minimum.

2. A process as in claim 1 wherein the alkali metal chloride is sodium chloride.

3. A process as in claim 2 wherein a mineral acid is added to the aqueous solution in the anode chamber to maintain the pH of the solution at a value up to 3.5.

4. A process as in claim 3 wherein the mineral acid is hydrochloric acid.

5. A process as in claim 1 wherein the pressure is controlled by adjusting the difference of gas pressure at the exit of the anode and the cathode chambers.

6. A process as in claim 1 wherein the pressure is controlled by adjusting the amount of electrolyte solution in each chamber.

7. A process as in claim 1 wherein the pressure in the cathode chamber is higher than the pressure in the anode chamber being a value of from 0.2 to 5 meters of water.

8. A process as in claim 1, wherein the volume of the cathode chamber is larger than the volume of the anode chamber.

* * * * *